United States Patent [19]

Ehrhart et al.

[11] Patent Number: 5,011,820

[45] Date of Patent: Apr. 30, 1991

[54] SUPERCONDUCTING CURRENT ACCUMULATOR WITH PULSED OUTPUT

[75] Inventors: Peter Ehrhart; Andreas Gründel, both of Munich; Götz Heidelberg, Starnberg-Percha; Wener Weck, Starnberg, all of Fed. Rep. of Germany

[73] Assignee: Heidelberg Motor GmbH Gesellschaft für Energiekonverter, Starnberg, Fed. Rep. of Germany

[21] Appl. No.: 391,519

[22] PCT Filed: Nov. 18, 1988

[86] PCT No.: PCT/EP88/01051

§ 371 Date: Jul. 20, 1989

§ 102(e) Date: Jul. 20, 1989

[87] PCT Pub. No.: WO89/05033

PCT Pub. Date: Jun. 1, 1989

[30] Foreign Application Priority Data

Nov. 20, 1987 [DE] Fed. Rep. of Germany ..... 3739411

[51] Int. Cl.[5] ..... H01B 12/00

[52] U.S. Cl. ..... 505/1; 323/360; 336/DIG. 1; 505/701; 505/703; 505/870

[58] Field of Search ..... 323/360; 336/DIG. 1; 363/14; 505/1, 701, 703, 870

[56] References Cited

U.S. PATENT DOCUMENTS

| | | | |
|---|---|---|---|
| 3,205,461 | 9/1965 | Anderson | 505/805 |
| 3,395,000 | 7/1968 | Hanak et al. | 29/194 |
| 3,667,029 | 5/1972 | Bergmann | 336/DIG. 1 |
| 3,800,256 | 3/1974 | Garwin | 335/216 |
| 4,032,959 | 6/1977 | Boom et al. | 336/DIG. 1 |
| 4,122,512 | 10/1978 | Peterson et al. | 363/14 |
| 4,195,334 | 3/1980 | Perry et al. | 363/44 |
| 4,336,561 | 6/1982 | Murphy | 361/19 |
| 4,337,905 | 3/1983 | Agatsuma et al. | 335/216 |
| 4,414,461 | 11/1983 | Wolf | 336/DIG. 1 |
| 4,493,014 | 1/1985 | Higashino | 363/14 |
| 4,584,518 | 4/1986 | Higashino et al. | 363/14 |
| 4,599,519 | 7/1986 | Boenig | 363/14 |
| 4,609,831 | 9/1986 | Higashino et al. | 363/14 |
| 4,695,932 | 9/1987 | Higashino | 363/14 |
| 4,920,095 | 4/1990 | Ishigaki et al. | 505/1 |
| 4,939,444 | 7/1990 | Cacheux | 323/360 |
| 4,954,727 | 9/1990 | Hilal | 307/112 |

FOREIGN PATENT DOCUMENTS

| | | |
|---|---|---|
| 2112054 | 6/1972 | France . |
| 1001499 | 8/1965 | United Kingdom . |

OTHER PUBLICATIONS

Rogers et al.; "Superconducting Magnetic Energy Storage for Electric Utilities and Fusion Systems"; Adv. in Instru., vol. 33, Jun. 78.

Eriksson et al.; "Superconducting Pulse Magnet For Energy Storage and It's Nonmetallic Cryostat"; IEEE Magnetics, vol. 23, No. 2, 3/87.

*Primary Examiner*—Steven L. Stephan
*Assistant Examiner*—J. Sterrett
*Attorney, Agent, or Firm*—Spencer & Frank

[57] ABSTRACT

A process for supplying a current consumer with current from an accumulator for electrical energy, in which electrical energy pulses of very short duration each are supplied to the current consumer from a superconducting accumulator (2) made with superconductors (8) of very small diameter or very small layer thickness. The superconductors (8) are preferably high-temperature superconductors.

37 Claims, 3 Drawing Sheets

SUPERCONDUCTING CURRENT ACCUMULATOR WITH PULSED OUTPUT

BACKGROUND OF THE INVENTION

The invention relates to a process for supplying a current consumer with current from an accumulator for electrical energy, well as to a current accumulator suitable for carrying out said process.

The design and procedure of current delivery prevailing so far in current accumulators have been such that a current accumulator delivered the required energy in a continuous or quasi-continuous manner over a relatively long period of time.

SUMMARY OF THE INVENTION

The object to be met by the invention is to make available a process for supplying to make available a consumer with current from a current accumulator, as well as a current accumulator having a high storage capacity in relation to volume or weight, while enabling storage with extremely low losses and enabling also discontinuous current delivery.

To meet this object the process, according to the invention, is characterized in that electrical energy pulses of very short duration each are supplied to the current consumer . from a superconducting accumulator coil composed of superconductors of very small diameter or very small layer thickness. The current accumulator according to the invention is characterized in that it is designed as a superconducting accumulator coil having superconductors of very small diameter or very small layer thickness.

The invention thus teaches the use of a superconducting accumulator coil of such construction that the energy delivery is possible in the form of very short energy pulses, and with extremely low eddy current losses.

Especially suitable small diameters or small layer thicknesses of the superconductors are less than 20 μm, preferably less than 10 μm. Especially suitable short periods of time of the respective energy pulses are less than 10 ms, preferably less than 5 ms and most preferably less than 1 ms.

A particularly preferred embodiment of the invention consists in making the accumulator coil with high-temperature superconductors. High-temperature superconductors are superconductors that are still superconducting at considerably higher temperatures than those considered possible in principle until recently. As a handy limit for these materials, one may indicate a transition temperature, i.e. temperature of the transition from the superconducting state into the normally conducting state, of 80° K. It is typical that high-temperature superconductors are still superconducting at a temperature slightly below the boiling point of liquid nitrogen. Typical materials for high-temperature superconductors are $ABa_2Cu_3O_7$ (wherein A=YLa, Nd, Sm, Eu, Gd, Ho, Er, Lu as well as $Y_{1.2}Ba_{0.8}CuO_4$. Another example is $La_{1.85}Sr_{0.15}CuO_4$, is to be indicated as which has a transition temperature of approx. 40° K. and is not a high-temperature superconductor according to the above definition. These materials usually are so-called layer conductors or two-dimensional superconductors. High-temperature superconductors are known per se, just as conventional superconductors, whose transition temperature is in the rang of several degrees Kelvin, and there is no need for indicating more concrete examples in this respect, since these are generally known.

Despite the very short energy pulse duration preferably employed for discharging the accumulator coil according to the invention, high energy or power delivery is possible because of the considerable energy content per energy pulse and because of the large number of possible successive energy pulses. Typical values are more than $10_8$ W per energy pulse, preferably $10^8$ to $10^{11}$ W.

The small diameter or small layer thickness of the superconductors of the accumulator coil, provided according to the invention, has the effect that the eddy current losses in the superconductors are kept as low as possible also in case of an energy delivery in the form of very short energy pulses in terms of time. Possibilities of manufacture of such superconductors, which are preferred according to the invention, are vacuum evaporation, local mechanical removal or etching of portions from a layer of larger area, as well as winding of the accumulator coil from very thin wires, so-called filament wires. Not only winding but also evaporation and local layer removal provide the possibility of having, when viewing an accumulator coil cross-section, several superconductors or superconductor rings on top of each other in the radial direction so as to increase the storage capacity per unit of length of the accumulator coil, for instance by repeated evaporation or repeated layer application and repeated material removal. Between the individual superconductor layers there are usually disposed insulating intermediate layers which, for instance, may be formed by evaporation and may consist, for instance of aluminum oxide. Such manufacturing techniques may be performed such that the radially successive layers or coatings electrically provide a winding-like structure. However, in terms of manufacture it is often more convenient to form ring-like layers or coatings and to electrically contact or terminate each thereof. In case of a winding structure of the accumulator coil it is preferred to wind the superconducting filament wires in an alternating manner with very thin normal-conduction metal wires. The normal-conduction metal wires appropriately should be at least as thin as the superconducting filament wires, so as to keep the eddy current losses as low as possible also in the normal-conduction wires. The term "in an alternating manner" is not to be understood only in the strict sense of the word. Rather, what is to be expressed is that the aim is a matrix-like structure partly of superconducting and partly of normal-conduction filament wires, without the cogent requirement that one superconducting filament must cogently alternate exactly with one normal-conduction wire. The result of this structure is that, even in case of a breakdown of superconduction in the superconducting filament wires, at least the normal conduction in the normal-conduction wires is still maintained As a further development of the invention, it is particularly preferred when the accumulator coil is composed with several successive coil segments in the longitudinal direction of the accumulator coil. It is even possible to separately prefabricate the individual coil segments and to then join them to form the accumulator coil. These measures simplify the structure and the manufacture of the accumulator coil. Besides, it is possible in a particularly simple manner, according to unit construction principles, to selectively build accumulator coils with smaller or larger storage capacity. However, it is possible as well to manufacture the entire accumulator coil as a whole, for instance to wind the coil with a continuous superconducting filament wire on a coil core.

When a structure of coil segments is used, it is preferred for reasons of simplification that the coil segments are magnetically coupled with each other and have, for instance, a common coil core. However, an electrical interconnection of the coil segments is possible as well.

A construction of the accumulator coil of coil segments provides the preferred possibility of interconnecting part or all of the coil segments for charging the accumulator coil and/or of having a different interconnection of the coil segments for charging and for discharging, with the coil segments active during charging being not necessarily identical with the coil segments active during discharging. A particularly preferred possibility consists in charging the accumulator coil using a series connection of part or all of the coil segments and in discharging it using a parallel connection of part or all of the coil segments. In this manner, upon discharge of n coil segments, one obtains the n-th discharging current of one individual coil segment. Furthermore, it is possible by means of switching components to render selectable the number of coil segments which are directly cooperating during discharge, so that the magnitude of the discharging current can be adjusted in this simple manner. The charging current is as a rule substantially unchanged.

It is possible to interconnect several magnetically coupled accumulator coils, especially for discharge.

The easiest possibility for charging the accumulator coil consists in connecting it to a primary current circuit. Alternatively or in addition thereto it is possible, and preferred for many purposes of application, to charge the accumulator coil magnetically or inductively a charging means. Magnetic flow quanta can be introduced in the accumulator coil especially according to the flow pump principle, i.e. in a time-distributed manner in so small "portions" that the superconducting state of the superconductors does not break down. Preferred technical possibilities therefor are a pulsating magnetic field, produced preferably by a rotatable magnet ring with permanent magnets, or a pulsating field of a current conductor, which leads to the inductive introduction of magnetic flow quanta. It is possible to use the rotating mass of the magnet ring in addition to energy storage. The magnet ring is driven preferably mechanically or by an electric motor, and particularly is driven directly. Charging of the accumulator coil may be carried out by means of a flywheel accumulator, either in such a form that the afore-mentioned magnet ring is part of the flywheel of the flywheel accumulator which is charged preferably by an integrated electric motor with increasing speed, or in such a form that electric current produced in the generator mode of operation of the flywheel accumulator is fed to the accumulator coil.

The preferred geometric configurations of the accumulator coil are a toroidal configuration (=annularly curved hollow cylinder) and solenoid configuration (=hollow cylinder). The toroidal configuration leads to a particularly compact current accumulator and offers, furthermore, particularly favorable geometrical-functional conditions for charging in accordance with the flow pump principle. As regards the toroidal configuration of the accumulator coil, the term "longitudinally of the accumulator coil" used in the present text is to be understood such that this longitudinal direction extends circularly in a manner corresponding to the circular shape of the center axis of the coil.

Especially favorable conditions under the aspect of minimization of the edge effects of the coil are obtained when—as is preferred—the ratio between the radial thickness of the space equipped with superconductors and the accumulator coil diameter is small. This means, depending on the desired storage capacity of the accumulator coil, the diameter of the entire accumulator coil (in case of the toroidal configuration measured with respect to a cross-section of the toroidal ring) is made as great as possible and the radial thickness of the coil proper or of the coil segments proper is made as small as possible.

The accumulator coil may be designed as a coreless coil or air-core coil. Preferably the accumulator coil is formed with a core composed of superconducting material, in particular in the form or a layered structure alternating between insulating material and very thin superconducting layers. The core urges the magnetic field of the coil or coil segments outwardly and thus leads to a magnetic field concentration.

It is possible to alter or adjust the current intensity in the accumulator coil by the transition of the material of the core from the superconducting state into the state of normal conduction, and vice versa. This can be achieved in principle by changing the temperature of the core, in particular by thermal energy irradiation. Particulary preferred is a means for applying a sufficiently strong magnetic field to the core, which does not interrupt the superconducting state of the core. Further possibilities are the introduction of a sufficiently strong current pulse or of an additional current pulse into the core, irradiation of a radio-frequency field into the core, subjecting the core to the influence of a laser beam and/or subjecting the core to the influence of a maser beam. What must be noted on the whole is that the field strengths and/or temperatures produced in the material of the core of the accumulator coil shall not influence the desired superconducting state of the accumulator coil.

The accumulator coil preferably has one or more superconducting discharging coils magnetically coupled to the superconductors. These may be coil segments of the accumulator coil proper. However, it is also possible to provide separate discharging coils between the windings or coil segments proper of the accumulator coils. In doing so, a transformer effect can be utilized in case of differring winding numbers.

The technical construction of the accumulator coil in most cases is such that at least the superconductors thereof are arranged in a helium bath or—in case of high-temperature superconductors—in a nitrogen bath. The entire accumulator coil can be disposed in such a bath. In this case, the construction usually is such that this bath can dissipate the losses caused by the feasible sources and making themselves felt as generation of heat, without the superconducting state in the accumulator coil and/or in the core thereof breaking down. Such heat sources are in particular the eddy currents in the superconductors that cannot be eliminated completely, the current heat losses in the metal filaments of the coil, the losses, in particular eddy current losses, in the core of the coil, the heat generated and finely flowing in the region of current supply and current delivery, etc. This holds also for the state in which the core material has been transformed into the normally conducting state.

The laser or maser means mentioned hereinbefore may be disposed in the core material and shielded in a suitable manner from the superconductors of the coil proper, so that this means during operation thereof does not impair the superconducting state of the coil material.

The energy pulses withdrawn during discharge of the accumulator coil can be of such short length in time that the deflectional movements of the flexible flow tubes in the superconducting material of the coil proper and, possibly, of the core are reduced and losses occurring concomitantly therewith are lowered thereby.

The accumulator coil according to the invention also is especially well suited for supplying current to consumers requiring short-time current pulses of high energy. Highenergy workpiece processing machines can be indicated as a typical example thereof.

The accumulator coil according to the invention preferably is discharged with the aid of one or several superconducting high-current switches. This high-current switch may have superconductors in the form of thin films, thin wires or powder in a non-conducting matrix. The switch has a means through which the superconducting material can be converted from the superconducting state into the non-superconducting state and vice versa. Preferably, cooling passages are provided between the layers or wires or powder arrangements, respectively, of the superconducting material.

BRIEF DESCRIPTION OF THE DRAWINGS

The invention and further developments of the invention will now be elucidated in more detail on the basis of embodiments shown schematically in the drawings, in which.

DESCRIPTION OF THE PREFERRED EMBODIMENTS

Figure 1:
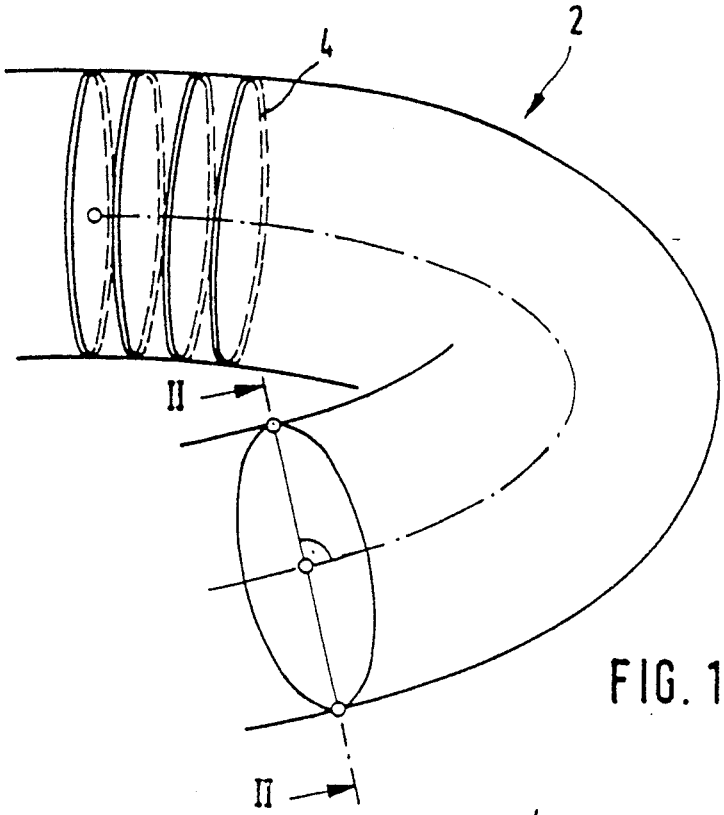
FIG. 1 shows a perspective view of a part of a toroidal accumulator coil.

The accumulator coil 2 shown in FIG. 1 is of toroidal configuration and has a round, circular torus cross-section according to II—II. The supporting structure of the accumulator coil 2 consists of insulator material and can be illustrated geometrically as a hollow cylinder bent into a circular shape. The supporting structure can be designed as shown more clearly by the embodiment according to FIG. 2.

On the supporting structure, along the toroidal ring, there are disposed successive coil segments 4 which, when seen per se, are of circular configuration each. These coil segments are wound, for instance, from very thin filament wires or composed with a radially successive layer sequence of insulating material and conducting material, cp. also the embodiment according to FIG. 2. The coil segments 4 are connected to each other in an electrically conducting manner, the type of connection being elucidated in more detail hereinafter.

The current conductors of the coil segments 4 consist of superconducting material, preferably high-temperature superconducting material. Either the entire accumulator coil 2 is disposed in a bath of liquid helium or—in the case of high-temperature superconductors—in a bath of liquid nitrogen. Or cooling of the superconductors is carried out by means of smaller cooling spaces having liquid helium or liquid nitrogen flowing therethrough, as illustrated for instance in the embodiment according to FIG. 2. Connections to an external primary charging circuit and to an external secondary discharging circuit are provided, but not shown in the drawings.

Figure 2:
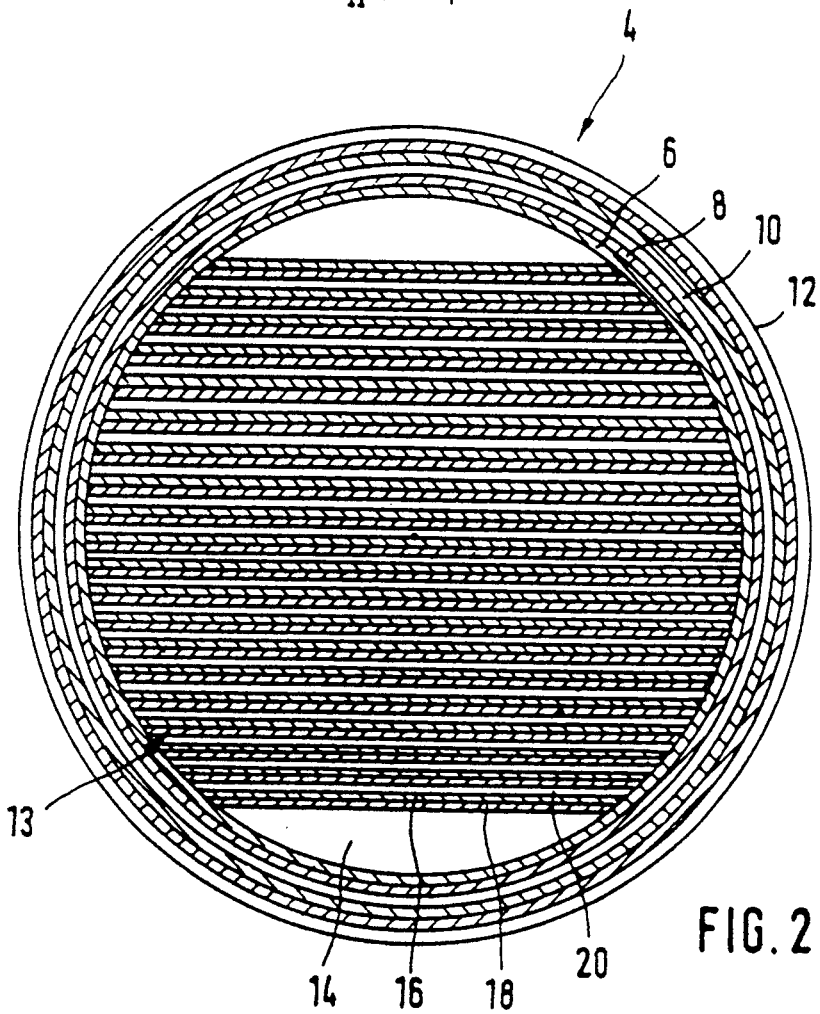
FIG. 2 shows a cross-sectional view of an accumulator coil, for instance a cross-section along the line II—II in FIG. 1, having a superconducting coil core.

FIG. 2 illustrates a preferred structure of a coil segment 4 in more detail. Reference numeral 6 designates the insulating supporting structure generally outlined hereinabove. Disposed thereon is a superconducting ring 8, for instance in the form of a thin film evaporated thereon, or of a ceramic layer applied in a different manner, or of a ring remainder left standing from a coating of superconducting material previously applied along the accumulator coil 4 in continuous manner. Radially outside of the ring 8, there is provided an annular or cylindrical coolant space 10 having liquid helium or nitrogen flowing therethrough.

The structure described is repeated once more or several times more in a manner progressing radially outwardly. On the very outside, the outermost coolant space 10 is enclosed by a housing 12.

The superconducting rings 8 can be electrically connected individually. However, it is for instance possible as well to electrically interrupt each superconducting ring 8 at a peripheral location and to electrically connect the individual interrupted rings in such a manner that, so to speak, a coil with radially successive windings is simulated.

Inside of the supporting structure 6 there are provided carrier insulators 14 of segment shape in the cross-section shown. Between the two carrier insulators 14, there is located a core 13 which, in a manner quite similarly to the structure of the coil segments 4 proper, is a layer sequence of insulator layers 16, very thin superconducting layers 18 and of flat cooling spaces 20 having liquid helium or liquid nitrogen flowing therethrough.

Figure 3:
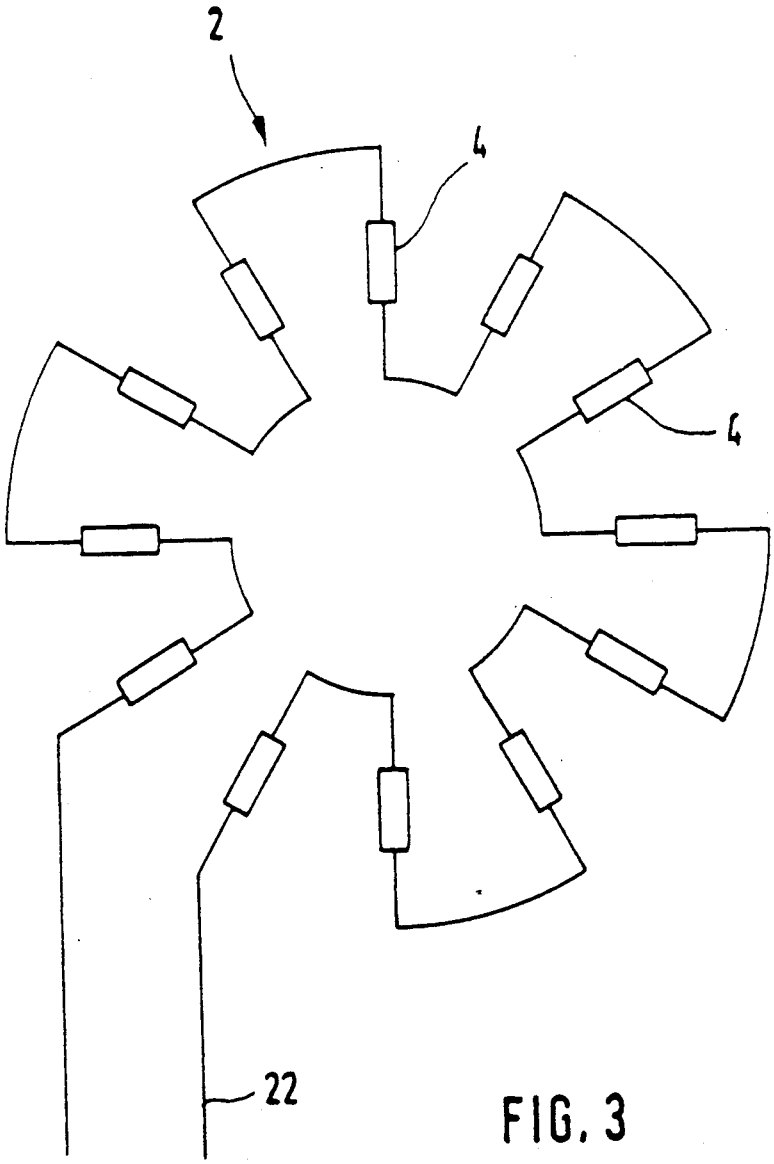
FIG. 3 shows the electrical connection of coil segments during charging of the accumulator coil.
Figure 4:
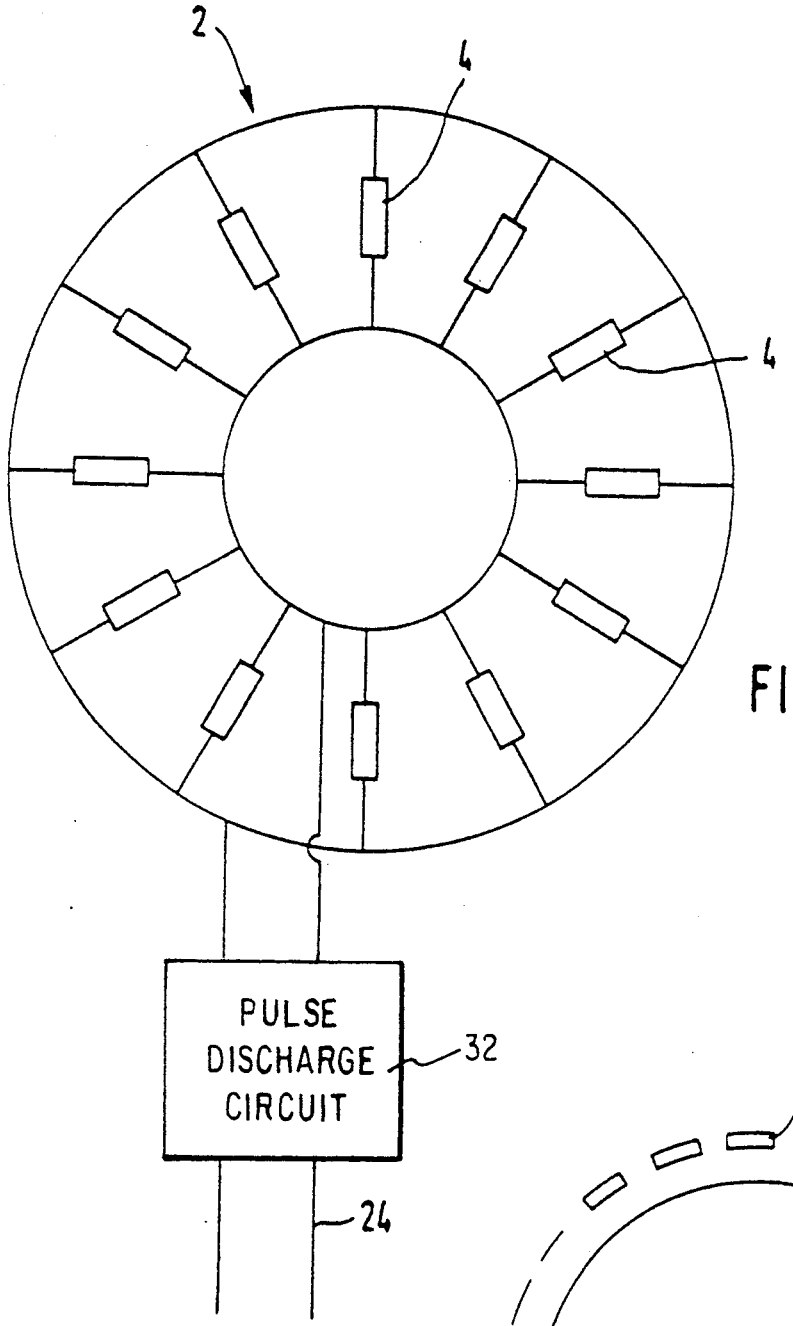
FIG. 4 shows the electrical connection of coil segments of the accumulator coil during discharge.

Instead of the described layer structure of the coil segments 4 of insulator material 6 and superconducting material 8, it is also possible to provide a coil segment 4 wound from very thin superconducting filament wires, possibly in more or less strictly alternating manner with very thin, normal-conduction metal filaments. FIGS. 3 and 4 illustrate the manner of interconnection of the individual coil segments 4 which together constitute the toroidal accumulator coil 2. During charging, a series connection of the coil segments is preferred (FIG. 3), whereas during discharge of the accumulator coil 4 a parallel connection of the individual coil segments 4 is preferred (FIG. 4). FIGS. 3 and 4 also reveal the ends of the primary circuit 22 and of the secondary circuit 24.

During discharge, electrical energy pulses of very short duration are supplied from accumulator coil 2 to the current consumer (not shown). To produce the pulses, a pulse discharge circuit 32 is provided in secondary circuit 24. One or more superconducting high-current switches may be included in discharge circuit 32. Energy pulses of less than 10 ms duration are especially suitable, with pulses shorter than 5 ms being preferred and with pulses shorter than 1 ms being better still. This is especially well suited for supplying current to consumers requiring short-duration current pulses of high energy, such as high-energy workpiece processing machines. The withdrawal of energy in very brief pulses from an accumulator coil 2 with very thin superconductors has the added benefits that deflectional movements of the flow tubes in the superconducting material are reduced and eddy current losses are extremely low.

When no separate coil segments 4 are provided for charging and discharging the accumulator coil 2, it is favorable to design the connection of the coil segments 4 such that is possible to change from a series connection to a parallel connection and vice versa. It is to be understood that the connection may also be designed such that during discharge selectively either all or only a smaller or larger part of the coil segments 4 is directly employed, for instance only every second or every third coil segment 4, so that the current load along the torus is evenly distributed.

In case the accumulator coil is not of toroidal configuration, as shown, but of solenoid configuration, the torus has to be conceived as being cut open at one location and being brought into a rectilinear shape.

Figure 5:
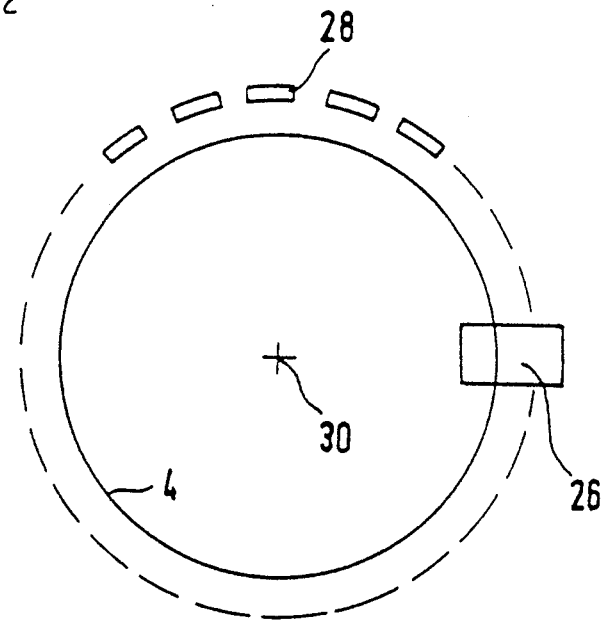
FIG. 5 shows a cross-sectional view of an accumulator coil, for instance along the line II—II in FIG. 1, for schematically illustrating the introduction of magnetic flow quanta in the accumulator coil.

FIG. 5 schematically illustrates a further preferred possibility of charging the accumulator coil 2. A superconducting platelet 26, which is very thin in accordance with the superconductor thickness and whose plane extends perpendicularly to the axis of the torus ring, projects radially outwardly beyond the respective coil segment 4. A ring 28 of magnets can be rotated concentrically with respect to the axis 30 of the torus ring. In front of the drawing plane of FIG. 5 the ring of magnets has a series of permanent-magnet north poles which are circumferentially spaced, and to the rear of the drawing plane of FIG. 5 it has a series of permanent-magnet south poles which are circumferentially distributed in the same manner. Each time such a pair of north pole and south pole passes the platelet 26 with a slight air gap therebetween, magnet quanta are deposited on the platelet 26 and migrate into the coil segment 4 electrically connected to the platelet 26. In this way, the respective coil segment 4 can be charged in a time-spread manner. An accumulator coil of solenoid configuration can be charged in a quite analogous manner, with the ring 28 of magnets rotating about the rectilinear solenoid axis.

With the toroidal accumulator coil 2 shown, the illustrated ring 28 of magnets, as an alternative, may be designed to rotate along the torus, i.e. about an axis perpendicular to the drawing plane of FIG. 5 and extending through the center of the torus ring. In this case, the platelet 26 would have to be conceived as being tilted upwardly in FIG. 5 by 90°; the north poles would be located above the platelet 26 and the south poles therebelow.

What is claimed is:

1. A process for supplying a current consumer with current, comprising the steps of:

storing energy in a superconducting accumulator coil having thin superconductors; and electrically connecting the accumulator coil to the current consumer via at least one switch which is opened and closed at high frequency to supply the current consumer with DC pulses of high power and short duration.

2. A process according to claim 1, wherein the pulse duration of the DC pulses is less than 10 ms.

3. A process according to claim 2, wherein the pulse duration of the DC pulses is less than 5 ms.

4. A process according to claim 3, wherein the pulse duration of the DC pulses is less than 1 ms.

5. A current accumulator for accumulating electrical energy and for supplying a current consumer with electrical current, comprising:

a superconducting accumulator coil having thin superconductors; and pulse discharge means for selectively connecting the accumulator coil to the current consumer to supply the current consumer with DC pulses of high energy and short duration, the pulse discharge means including at least one switch which is opened and closed at high frequency and which electrically connects the accumulator coil to the current consumer when that at least one switch is closed.

6. A current accumulator according to claim 5, wherein the superconductors are high-temperature superconductors having a transition temperature of at least about 80° K.

7. A current accumulator according to claim 5, wherein the superconductors having a diameter of less than 20 $\mu$m.

8. A current accumulator according to claim 5, wherein the superconductors are provided in the form of layers, each having a layer thickness of less than 20$\mu$m.

9. A current accumulator according to claim 5, wherein the superconductors are formed from a layer applied across a large area, by local mechanical removal of material from the layer.

10. A current accumulator according to claim 5, wherein, when viewing the accumulator coil cross-section, several superconductor layers are provided following each other in the radial direction.

11. A current accumulator according to claim 10, wherein the accumulator coil additionally comprises insulating intermediate layers, and wherein the superconductor layers are formed successively, with an insulating intermediate layer being provided therebetween, and are each electrically terminated.

12. A current accumulator according to claim 5, wherein the accumulator coil comprises wound, thin, superconducting filament wires.

13. A current accumulator according to claim 12, wherein the accumulator coil further comprises thin normal-conduction wires, and wherein the superconducting filament wires are provided substantially in an alternating manner with the thin normal-conduction metal wires.

14. A current accumulator according to claim 5, wherein the accumulator coil comprises a plurality of successive coil segments in the longitudinal direction thereof.

15. A current accumulator according to claim 14, wherein the coil segments are individually prefabricated and are then joined to form the accumulator coil.

16. A current accumulator according to claim 14, wherein the coil segments are magnetically coupled.

17. A current accumulator according to claim 14, wherein the coil segments are connected in such a manner that the accumulator coil can be charged in a series connection of the coil segments and discharged in a parallel connection of all of the coil segments.

18. A current accumulator according to claim 5, wherein the accumulator coil is of toroidal configuration.

19. A current accumulator according to claim 5, wherein the accumulator coil is connected to a primary circuit for charging.

20. A current accumulator according to claim 5, further comprising charging means for charging the accumulator coil by introducing magnetic flow quanta according to the flow pump principle.

21. A current accumulator according to claim 5, further comprising charging means for charging the accumulator coil, the charging means including means for producing a pulsating DC magnetic field.

22. A current accumulator according to claim 21, wherein the accumulator coil is toroidal and wherein the means for producing a pulsating DC magnetic field comprises a rotatable magnet ring having permanent magnets.

23. A current accumulator according to claim 21, wherein the means for producing a pulsating DC magnetic field comprises a current conductor which produces a pulsating field, the accumulator coil being charged by induction.

24. A current accumulator according to claim 5, wherein the ratio between the radial thickness of the space equipped with superconductors and the accumulator coil diameter is small.

25. A current accumulator according to claim 5, wherein the accumulator coil comprises a core composed of superconducting material.

26. A current accumulator according to claim 25, further comprises state transition means for altering the current intensity in the accumulator coil by causing a transition of the superconducting material of the core from the superconducting state to the normal-conduction state and vice versa.

27. A current accumulator according to claim 26, wherein the state transition means comprises means for applying a magnetic field to the core.

28. A current accumulator according to claim 5, wherein the accumulator coil comprises at least one superconducting discharging coil magnetically coupled to the superconductors.

29. A current accumulator as claimed in claim 5, wherein the superconductors are less than about 20 μm thick and wherein each pulse has a duration of less than about 10 ms.

30. A current accumulator according to claim 5, wherein the superconductors are formed by local etching from a layer applied across a wide area.

31. A current accumulator according to claim 14, wherein the coil segments are connected in such a manner that the accumulator coil can be charged in a series connection of the coil segments and discharged in a parallel connection of some of the coil segments.

32. A current accumulator according to claim 5, wherein the accumulator coil is of solenoid configuration.

33. A current accumulator according to claim 26, wherein the state transition means comprises means for introducing a current pulse into the core.

34. A current accumulator according to claim 26, wherein the state transition means comprises means for irradiating a radio-frequency field into the core.

35. A current accumulator according to claim 26, wherein the state transition means comprises means for irradiating thermal radiation in the core.

36. A current accumulator according to claim 26, wherein the state transition means comprises means for subjecting the core to the influence of a laser beam.

37. A current accumulator according to claim 26, wherein the state transition means comprises means for subjecting the core to the influence of a maser beam.

* * * * *

UNITED STATES PATENT AND TRADEMARK OFFICE

CERTIFICATE OF CORRECTION

PATENT NO. : 5,011,820

DATED : April 30th, 1991

INVENTOR(S) : Ehrhart et al

It is certified that error appears in the above-identified patent and that said Letters Patent is hereby corrected as shown below:

Title page, Item (75), "Wener" should be -- Werner -- Please also insert the following additional co-inventor: --Gerhard Reiner, of Pähl, Germany.--

Signed and Sealed this

Twenty-second Day of April, 1997

Bruce Lehman

BRUCE LEHMAN

*Commissioner of Patents and Trademarks*

*Attest:*

*Attesting Officer*